US009644885B1

(12) United States Patent
Johnson

(10) Patent No.: US 9,644,885 B1
(45) Date of Patent: May 9, 2017

(54) SPACER FOR AN APPLIANCE

(71) Applicant: Electrolux Home Products, Inc., Charlotte, NC (US)

(72) Inventor: Glenn L. Johnson, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 14/972,135

(22) Filed: Dec. 17, 2015

(51) Int. Cl.
*F25D 25/02* (2006.01)
*F25D 23/08* (2006.01)
*F24C 15/16* (2006.01)

(52) U.S. Cl.
CPC ..... *F25D 25/02* (2013.01); *F24C 15/16* (2013.01); *F25D 23/08* (2013.01); *F25D 2325/023* (2013.01)

(58) Field of Classification Search
CPC ..... F25D 23/067; F25D 23/08; F25D 25/02; F25D 2325/023; F24C 15/16
See application file for complete search history.

(56) References Cited

U.S. PATENT DOCUMENTS 2,118,659 A 5/1938 Sywert
2,244,978 A 6/1941 Tinnerman
2,620,255 A 12/1952 Beckett
2,657,894 A 11/1953 Sklenar
2,876,910 A * 3/1959 Morton, Jr. ..... F25D 25/02 211/153
3,149,811 A * 9/1964 Gorton ..... A47B 61/003 211/162
3,235,219 A * 2/1966 Green ..... A47B 57/485 248/222.52
3,352,431 A * 11/1967 Smith ..... F25D 25/02 108/145
3,666,228 A * 5/1972 Arnold ..... A47B 57/30 248/250
4,195,888 A 4/1980 Squire
4,534,530 A * 8/1985 Danko ..... F16B 21/088 248/231.81
4,700,918 A * 10/1987 Andrasko, Jr. ..... A47K 3/001 211/105.1

(Continued)

FOREIGN PATENT DOCUMENTS

DE 19840415 A1 * 3/2000 ..... F25D 25/024
DE 102009045658 A1 * 5/2011 ..... F25D 23/00

(Continued)

*Primary Examiner* — Andrew Roersma
(74) *Attorney, Agent, or Firm* — Pearne & Gordon, LLP

(57) ABSTRACT

A spacer is provided for a shelf having a projection partially received within an aperture in a side wall of a cabinet. The spacer includes a conduit portion extending partially about an axis so as to define a channel extending through the conduit portion along the axis and a conduit opening extending radially through the conduit portion providing access to the channel. The channel is adapted to receive the projection of the shelf via the conduit opening. The spacer further includes an insert portion that extends axially from the conduit portion. The conduit portion includes first and second abutment surfaces extending orthogonal to the axis and facing away from each other. The second abutment surface is axially spaced from the first abutment surface. The first abutment surface extends from the axis a greater radial distance than the insert portion.

20 Claims, 6 Drawing Sheets

(56) References Cited

U.S. PATENT DOCUMENTS

| | | | | |
|---|---|---|---|---|
| 4,735,468 | A | 4/1988 | Taylor, Jr. et al. | |
| 5,855,424 | A | 1/1999 | Hamilton et al. | |
| 2005/0172830 | A1 * | 8/2005 | Giraud | F24C 15/16 99/448 |
| 2014/0174119 | A1 * | 6/2014 | Gultekin | F25D 23/006 62/465 |

FOREIGN PATENT DOCUMENTS

| | | | | |
|---|---|---|---|---|
| ES | 2395511 | A2 * | 2/2013 | F25D 25/00 |
| GB | 1001420 | A * | 8/1965 | A47B 55/02 |

* cited by examiner

SPACER FOR AN APPLIANCE

FIELD

The present invention relates generally to a spacer for an appliance, and, more particularly, to a spacer for spacing a shelf from a side wall of a refrigerator cabinet.

BACKGROUND

An appliance such as, for example, a refrigerator can include a cabinet defining a storage compartment and a shelf removably mounted within the storage compartment for storing items on the shelf within the storage compartment. To removably mount the shelf within the storage compartment, the shelf can include one or more projections that can be inserted into corresponding apertures in side walls of the cabinet.

The apertures of the cabinet are preferably sized to permit removable insertion of the projections in the apertures. For example, an inner diameter of each aperture can be relatively larger than a diameter of its associated projection to provide a substantial clearance therebetween. Moreover, the depths of the apertures can be designed such that when the shelf is installed with its projections in their associated apertures the shelf can slide laterally between the side walls of the cabinet. Such a loose fitting between the apertures of the cabinet and the projections of the shelf can permit the projections to be easily inserted into or removed from the apertures. However, such a loose fitting can also make the shelf unstable, particularly when there is an insubstantial weight of items being stored on top of the shelf Accordingly, it is desirable to help stabilize the shelf when mounted using projections and apertures as described above.

SUMMARY

In accordance with a first aspect, a spacer is provided for an appliance including a cabinet and a shelf having a projection partially received within an aperture in a side wall of the cabinet. The spacer includes a conduit portion extending partially about an axis so as to define a channel extending through the conduit portion along the axis and a conduit opening extending radially through the conduit portion to provide access to the channel. The channel is adapted to receive the projection of the shelf via the conduit opening. The spacer further includes an insert portion that extends axially from the conduit portion. The conduit portion includes a first abutment surface extending orthogonal to the axis and a second abutment surface extending orthogonal to the axis that faces away from the first abutment surface and is axially spaced from the first abutment surface a fixed distance. The first abutment surface extends from the axis a greater radial distance than the insert portion.

In accordance with a second aspect, an appliance includes a cabinet defining a storage compartment, the cabinet having a first side wall and an opposing second side wall. The appliance further includes a shelf that is removably installed within the storage compartment. The shelf includes a first projection partially received within a first aperture in the first side wall and a second projection on an opposing side of the shelf as the first projection that is partially received within a second aperture in the second side wall. The appliance further includes a spacer that spaces a portion of the shelf from the first side wall of the cabinet. The spacer includes a conduit portion extending partially about an axis so as to define a channel extending through the conduit portion along the axis and a conduit opening extending radially through the conduit portion to provide access to the channel. The first projection of the shelf is received within the channel. The spacer further includes an insert portion that extends axially from the conduit portion. The conduit portion includes a first abutment surface extending orthogonal to the axis and a second abutment surface extending orthogonal to the axis that is axially spaced from the first abutment surface a fixed distance and faces away from the first abutment surface. The first abutment surface extends from the axis a greater radial distance than the insert portion.

In accordance with a third aspect, a method of assembling an appliance includes providing a cabinet that defines a storage compartment, the cabinet having a first side wall and an opposing second side wall. The method further includes providing a shelf that is removably installed within the storage compartment. The shelf includes a first projection partially received within a first aperture in the first side wall and a second projection on an opposing side of the shelf as the first projection that is partially received within a second aperture in the second side wall. The method further includes providing a spacer for spacing a portion of the shelf from the first side wall of the cabinet. The spacer includes a conduit portion extending partially about an axis so as to define a channel extending through the conduit portion along the axis and a conduit opening extending radially through the conduit portion to provide access to the channel. The channel is adapted to receive the first projection of the shelf via the conduit opening. The spacer further includes an insert portion that extends axially from the conduit portion. The conduit portion includes a first abutment surface extending orthogonal to the axis and a second abutment surface extending orthogonal to the axis that is axially spaced from the first abutment surface a fixed distance and faces away from the first abutment surface. The first abutment surface extends from the axis a greater radial distance than the insert portion. The method further includes moving the spacer relative to the first projection such that the first projection is received within the channel of the spacer via the conduit opening and the spacer spaces a portion of the shelf from the first side wall of the cabinet by a minimum fixed distance.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
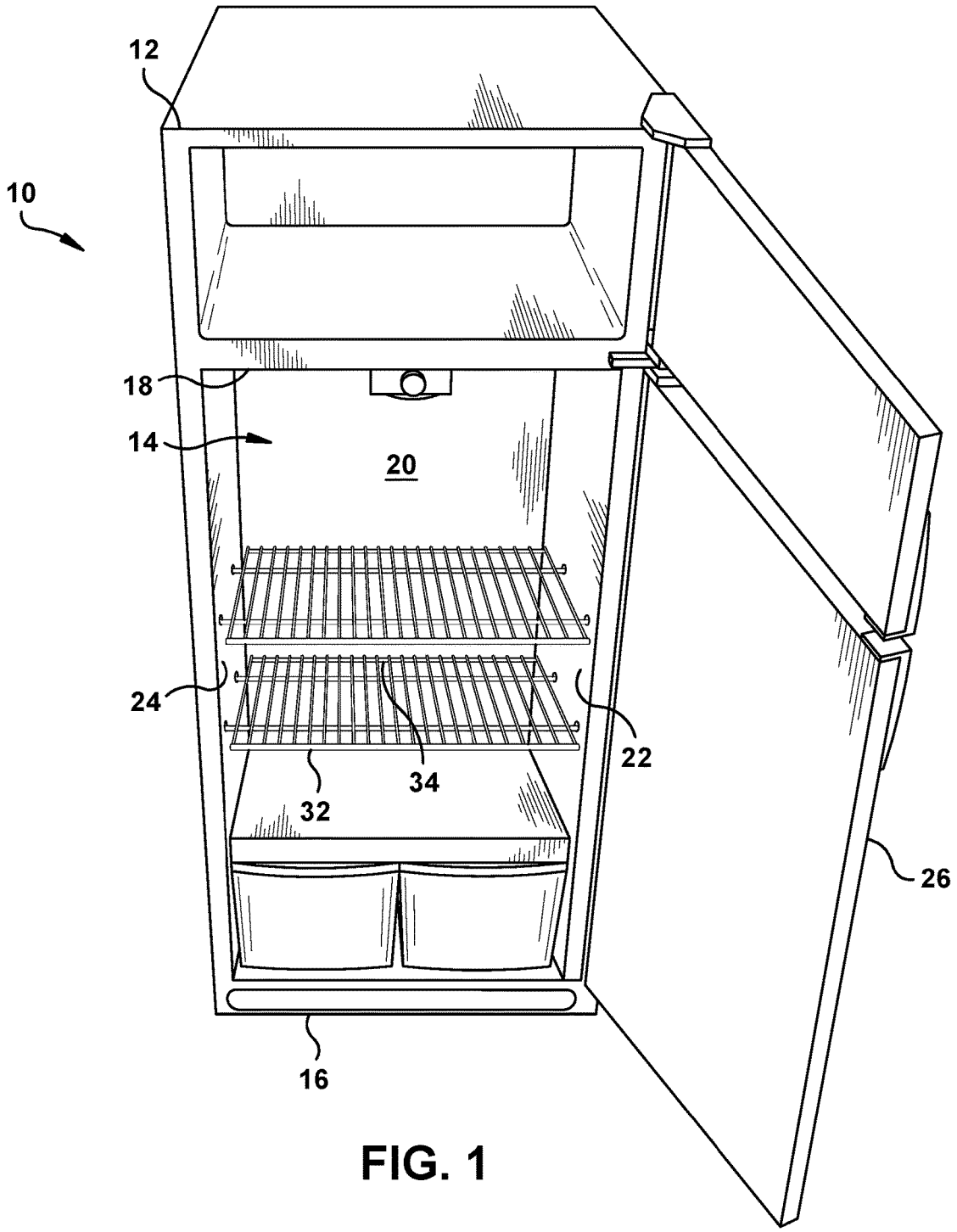
FIG. 1 is a front view of an example appliance.

An example appliance 10 is shown in FIG. 1 that includes a cabinet 12 that defines a storage compartment 14. The storage compartment 14 can be defined by a bottom wall 16, a top wall 18, a rear wall 20, and first and second opposing side walls 22, 24 of the cabinet 12. The appliance 10 can further include a door 26 that is movably coupled to the cabinet 12 for providing selective access to the storage compartment 14. For example, the door 26 can be pivotally coupled to the cabinet 12 using hinges or the door can be slidably coupled to the cabinet 12 using slides.

In the illustrated embodiment, the appliance 10 is a refrigerator having a fresh-food compartment and freezer compartment, the storage compartment 14 being the fresh-food compartment. However, in other examples, the storage compartment 14 may be the freezer compartment. Moreover, the appliance 10 may be a single-compartment refrigerator or the appliance 10 may be a non-refrigerator appliance such as, for example, a stove. The appliance 10 can be any cabinet-like structure including a cabinet that defines a storage compartment.

Figure 2:
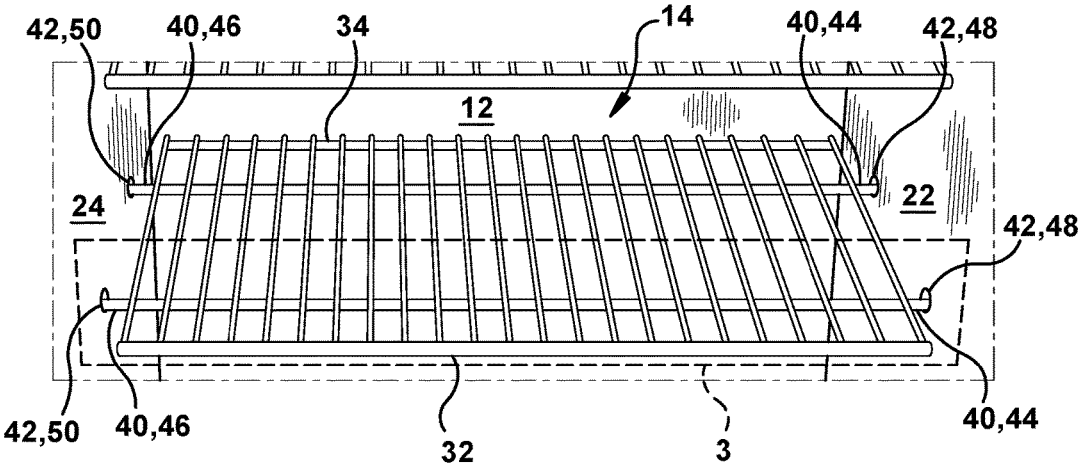
FIG. 2 is an enlarged view of shelf removably installed within a storage compartment of a cabinet of the example appliance.

The appliance 10 includes a shelf 32 that can be removably mounted within the storage compartment 14 for storing items such as food on the shelf 32 within the storage compartment 14. As shown in FIG. 2, the shelf 32 can include a shelf body 34 and one or more projections 40 that extend from the shelf body 34 and can be at least partially received within corresponding apertures 42 of the cabinet 12 to mount the shelf 32. For example, in the illustrated embodiment, the shelf 32 is a wire structure having metal rods arranged in a grid to form the shelf body 34 with a first set of projections 44 extending from a first side of the shelf body 34 and a second set of projections 46 extending from an opposing side of the shelf body 34. The first set of projections 44 can be at least partially received within a first set of corresponding apertures 48 in the first side wall 22 of the cabinet 12 and the second set of projections 46 can be at least partially received within a second set of corresponding apertures 50 in the second side wall 24 of the cabinet 12. However, the number and location of the projections 40 and apertures 42 can vary in other examples. Moreover, in some examples, the shelf body 34 and/or projections 40 can be formed with structure other than metal rods such as, for example, injection-molded plastic.

Figure 3:
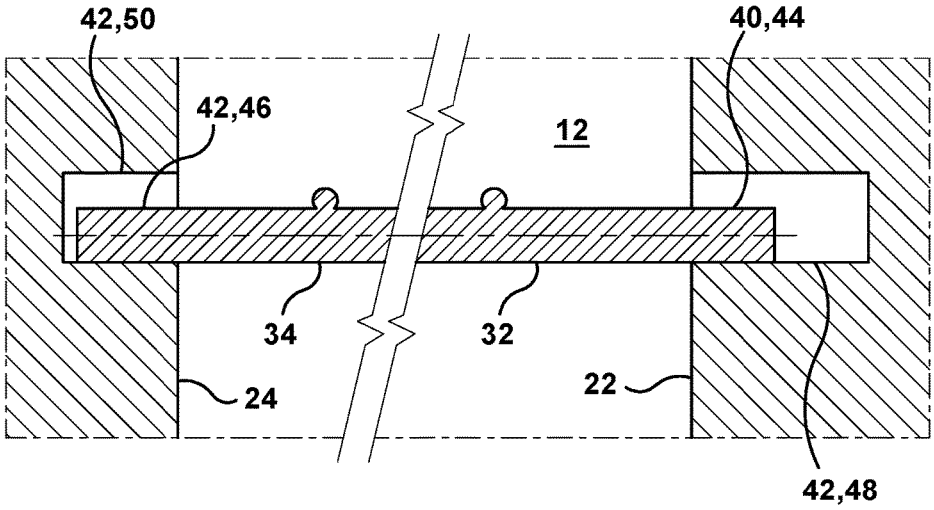
FIG. 3 is a cross-section view taken along plane 3 in FIG. 2.

The apertures 42 of the cabinet 12 are preferably sized to provide a loose coupling with the projections 40 of the shelf 32 to permit easy installation and removal of the shelf 32 to the cabinet 12. For example, as shown in FIGS. 2 & 3, the inner diameter of each aperture 42 can be relatively larger than a diameter of its associated projection 40 to provide a substantial clearance therebetween. In addition or alternatively, the depths of the apertures 42 can be extended such that when the shelf 32 is installed with its projections 40 in their associated apertures 42, the shelf can be shifted laterally between the first and second opposing side walls 22, 24. In some examples, the depth of the first set of apertures 48 can be greater than the depth of the second set of apertures 50, or vice versa. Such sizing of the apertures 42 can permit the shelf 32 to be installed by 1) tilting the shelf 32 to a non-horizontal position; 2) inserting the first set of projections 44 into the first set of apertures 48 in the first side wall 22 of the cabinet 12 while pivoting the shelf 32 to a horizontal position; and 3) then shifting the shelf 32 laterally toward the second side wall 24 of the cabinet to insert the second set of projections 46 into the second set of apertures 50 in the second side wall 24. However, it is to be appreciated that the depths and inner diameters of the apertures 42 can take on a variety of different configurations without departing from the scope of the invention.

When the projections 40 of the shelf 32 are loosely coupled to the apertures 42 of the cabinet 12 as described above, the shelf 32 can be unstable. For example, the shelf 32 could be shifted laterally between the first and second side walls 22, 24 of the cabinet 12. Also, if a downward force is applied at a front portion of the shelf 32, the shelf 32 may tilt about its front projections 40 such that its forward portion lowers while a rear portion of the shelf 32 rises. To help stabilize the shelf 32, the appliance can include one or more spacers to prevent such movement of the shelf 32.

Figure 4:
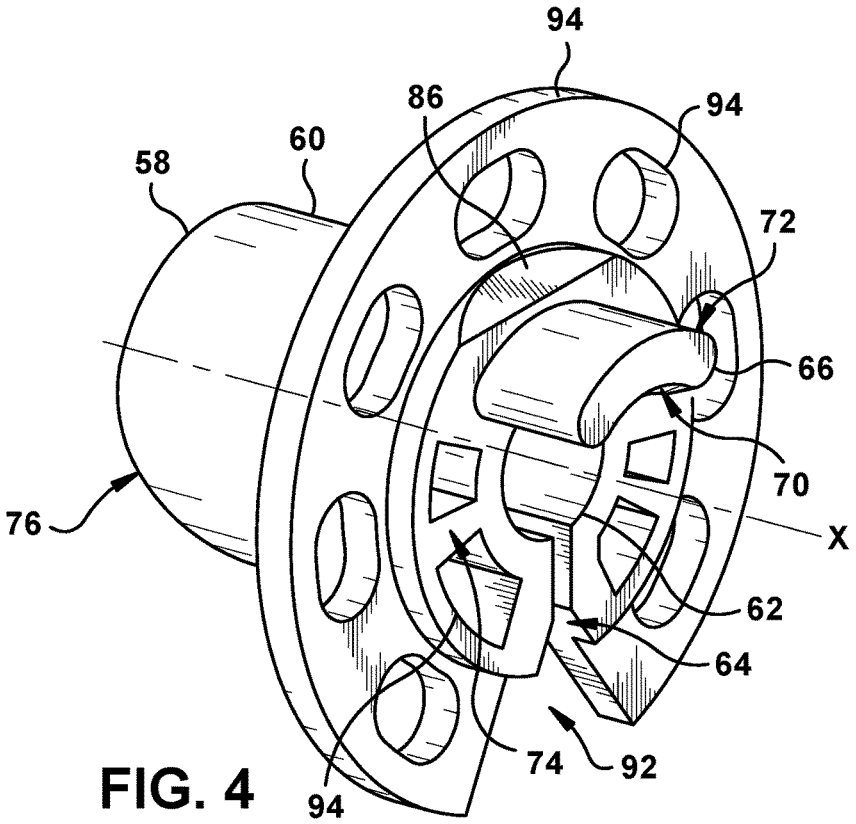
FIG. 4 is a perspective view of an example spacer for spacing a portion of the shelf from a side wall of the cabinet.
Figure 5:
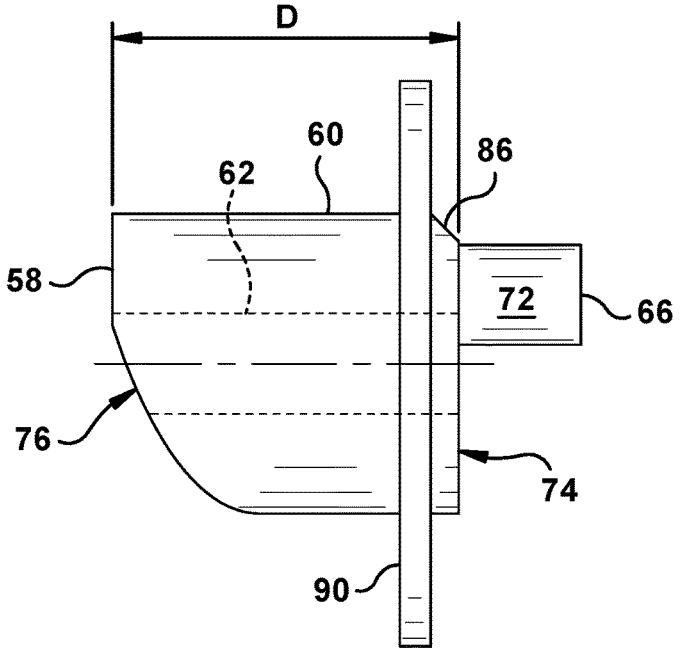
FIG. 5 is a side view of the example spacer.

One example spacer 58 is shown in FIGS. 4 & 5. The spacer 58 can include a conduit portion 60 extending at least partially about an axis X so as to define a channel 62 extending through the conduit portion 60 along the axis X and a conduit opening 64 extending radially through the conduit portion 60 to provide access to the channel 62. The spacer 58 can further include an insert portion 66 that extends axially from the conduit portion 60 about the axis X. (For the purposes of this disclosure, the term "axially" refers to a direction that is substantially parallel to the axis X and the term "radially" refers to a direction that intersects with and is substantially perpendicular to the axis X).

The insert portion 66 can include an inner arcuate surface 70 and an outer arcuate surface 72 that extend axially from the conduit portion 60 about the axis X, the inner arcuate surface 70 facing toward the axis X and the outer arcuate surface 72 facing away from the axis X. Meanwhile, the conduit portion 60 of the spacer 58 can include a first abutment surface 74 extending orthogonal to the axis X (i.e., non-axially) and a second abutment surface 76 extending orthogonal to the axis X that faces away from the first abutment surface 74 and is axially spaced from the first abutment surface 74 a fixed distance D. The first abutment surface 74 can extend from the axis X a greater radial distance than the insert portion 66.

Figure 6:
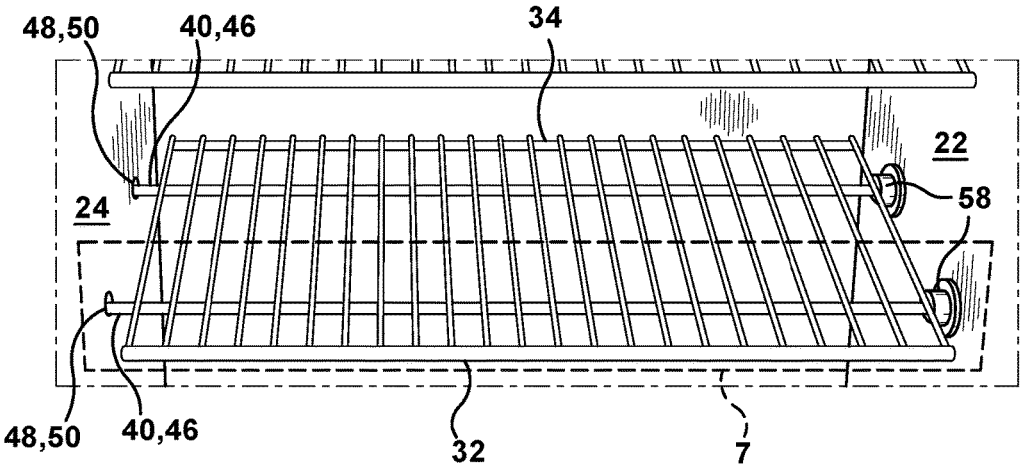
FIG. 6 is an enlarged view of the shelf removably installed within the storage compartment of the cabinet with two example spacers mounted on the shelf.
Figure 7:
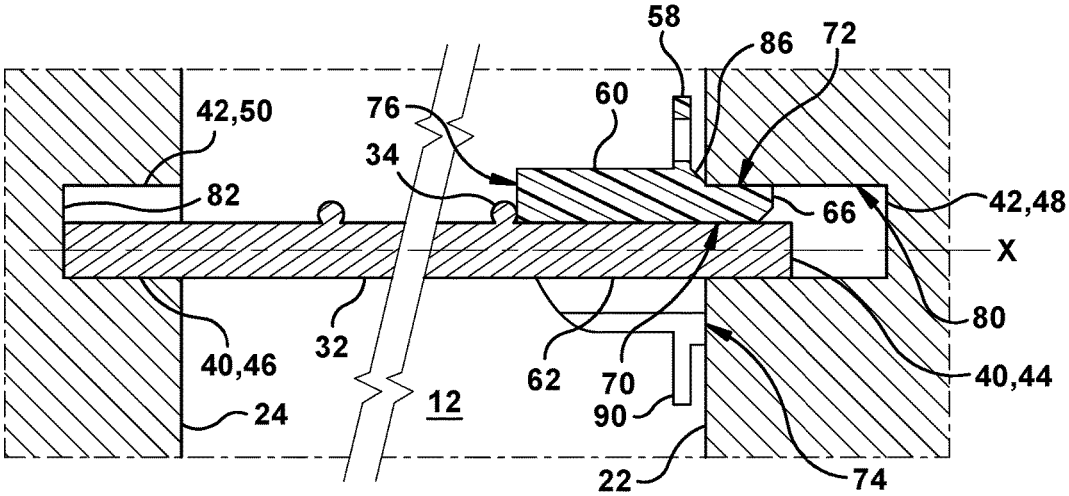
FIG. 7 is a cross-section view taken along plane 7 in FIG. 6.

The spacer 58 can be mounted to one or more of the projections 40 of the shelf 32 to help prevent movement of the shelf 32 relative to cabinet 12. For example, after the shelf 32 has been mounted to the cabinet 12, one spacer 58 can be mounted to each of the projections 40 in the first set of projections 44, as shown in FIGS. 6 & 7. To mount the spacer 58 to each projection 40, the spacer 58 can be positioned such that its conduit opening 64 is aligned with and faces the projection 40 and its insert portion 66 is directed towards the projection's associated aperture 42. The spacer 58 can then be moved relative to the projection 40 and aperture 42 such that the projection 40 enters the channel 62 of the spacer 58 via the conduit opening 64 and the insert portion 66 of the spacer 58 enters the aperture 42. The channel 62 of the spacer 58 can be adapted to receive the projection 40 via the conduit opening 64 such that the projection 40 is coaxial with the axis X of the conduit portion 60, as shown in FIG. 7. However, in some embodiments, the axis of the projection 40 may be offset and/or transverse to the axis X of the conduit portion 60.

When the spacer 58 is mounted as described above, the inner arcuate surface 70 of its insert portion 66 will abut the projection 40 while the outer arcuate surface 72 abuts an inner circumferential surface 80 of the aperture 42, thereby preventing radial movement of the projection 40 within the aperture 42. Moreover, the first abutment surface 74 of its conduit portion 60 will abut the first side wall 22 of the cabinet 12 and the second abutment surface 76 will abut a portion of the shelf 32 (e.g., shelf body 34), thereby spacing the portion of the shelf 32 from the first side wall 22 by the fixed distance D and preventing lateral movement of the shelf 32 toward the first side wall 22. Furthermore, the fixed distance D can be designed such that when the shelf 32 is spaced from the first side wall 22 by the spacer 58, a portion of the shelf 32 will also abut a portion of the second side wall 24. For example, a projection 40 in the second set of projections 46 can abut an end wall 82 of its associated aperture 42, thereby preventing lateral movement of the shelf 32 toward the second side wall 24, as shown in FIG. 7. Thus, by mounting the spacer 58 to a projection 40 as described above, the spacer 58 can prevent radial movement of the projection 40 within its associated aperture 42 and lateral movement of the shelf 32 between the first and second side walls 22, 24, thereby stabilizing the shelf 32.

As described above, one spacer 58 can be mounted to each of the projections 40 in the first set of projections 44. In addition or alternatively, one spacer 58 can be similarly mounted to each of the projections 40 in the second set of projections 46. Moreover, in some examples, a spacer 58 can be mounted to just one projection 40 in the first set of projections 44 and/or second set of projections 46. A spacer 58 can be mounted to any number of the projections 40 of the shelf 32 to help prevent movement of the shelf 32 relative to cabinet 12.

The spacer 58 can include a variety of different features to help facilitate installation of the spacer 58 on its respective projection 40. For instance, in some examples, the conduit opening 64 of the spacer 58 can be radially tapered such that a width of the conduit opening 64 increases along an outward radial direction from the axis X, as shown in FIG. 4. When tapered as such, the conduit opening 64 can help guide the projection 40 into the channel 62 when mounting the spacer 58 onto the projection 40. Also in some examples, the second abutment surface 76 can be curved such that a bottom portion of the second abutment surface 76 is axially spaced closer to the first abutment surface 74 than a top portion of the second abutment surface 76, as shown in FIG. 5. When curved as such, interference between the conduit portion 60 of the spacer 58 and the shelf 32 can be avoided when moving a projection 40 of the shelf 32 into the channel 62 of the spacer 58. Further in some examples, the first abutment surface 74 can include a chamfered portion 86 provided radially opposite of the conduit opening 64, as further shown in FIG. 5. This chamfered portion 86 can prevent interference between a side wall of the cabinet 12 and the first abutment surface 74 when moving the insert portion 66 of the spacer 58 into an aperture 42 of the cabinet 12. Still further in some examples, the spacer 58 can be made of a flexible and soft material such as, for example, a material having a hardness of 60 Shore A. By using a flexible material, the spacer 58 can be flexed to permit insertion of the projection 40 through the conduit opening 64 of the spacer 58 and to permit bending of the insert portion 66 as the spacer 58 is tilted and the insert portion 66 is moved into an aperture 42 of the cabinet 12. Moreover, a soft material will prevent the spacer 58 from causing damage (e.g., abrasion) to the shelf 32 and/or the cabinet 12. One example material that can be used for the spacer 58 includes a polyethylene, such as a flexible Linear Low Density Polyethylene (e.g., DOWLEX™ 2517). Other example materials that can be used for the spacer 58 include rubber, such as urethane, nitrile, or fluoro rubber. Other materials are possible in other examples.

Because the conduit portion 60 and insert portion 66 of the spacer 58 can be relatively small is overall size, the spacer 58 can also include a variety of different features to prevent the spacer 58 from being a choking hazard. For instance, in some examples, the spacer 58 can include a flange member 90 that extends radially from the conduit portion 60 to increase an overall radial size of the spacer 58 and thereby prevent the ability for a person such as a child to swallow the spacer 58, as shown in FIG. 4. To ensure that the flange member 90 does not interfere with mounting of the spacer 58 to a projection 40 of the shelf 32, the flange member 90 can extend partially about the axis X so as to define a flange opening 92 that extends radially through the flange member 90 to provide access to the channel 62 of the spacer 58 for the projection 40. Also in some examples, the flange member 90 and/or the conduit portion 60 of the spacer 58 can include one or more apertures 94 extending axially therethrough. In the chance that the spacer 58 is swallowed and becomes stuck within a person's throat, the one or more apertures 94 can provide a path for air to pass through the spacer 58.

Figure 8:
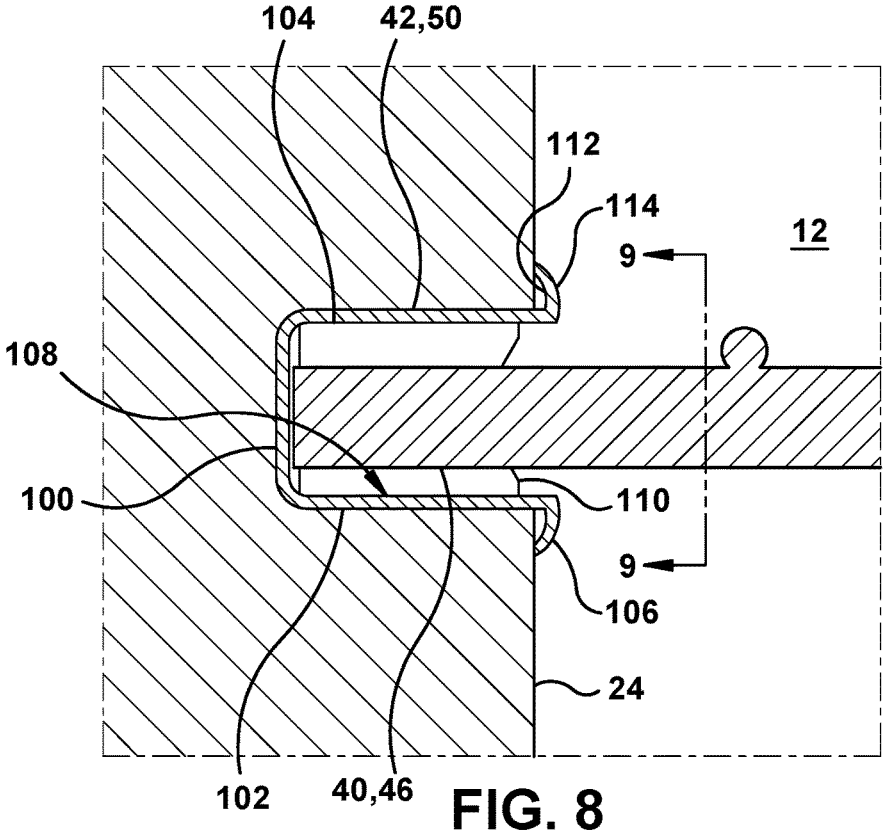
FIG. 8 is a cross-section view of a projection of the shelf provided at least partially within an aperture of the cabinet, with a ribbed sleeve provided at least partially within the aperture.
Figure 9:
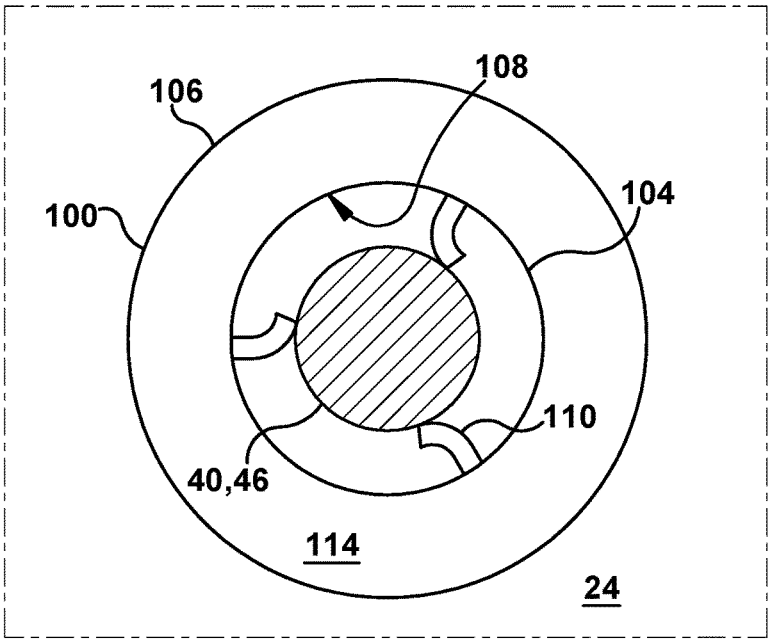
FIG. 9 is a cross-section view taken along line 9-9 in FIG. 8.

Turning now to FIGS. 8-11, in some embodiments, the appliance 10 can include one or more sleeves provided at least partially within corresponding apertures 42 of the cabinet 12 to provide a bearing interface between the apertures 42 and projections 40 of the shelf 32 and help stabilize the shelf 32. For example, as shown in FIGS. 8 & 9, the appliance 10 can include a ribbed sleeve 100 that can be at least partially provided within one or more apertures 42 of the cabinet 12. In particular, the ribbed sleeve 100 can be provided within an aperture 42 that will not have a spacer 58 inserted therein (e.g., an aperture 42 in the second set of apertures 50), though other apertures 42 are possible. The ribbed sleeve 100 can include a tubular body 102 having an aperture 104 extending therethrough and a lip portion 106 extending circumferentially outward from the tubular body 102. The tubular body 102 can have an inner circumferential surface 108 and can include one or more flexible ribs 110 extending inward from the inner circumferential surface 108.

The ribbed sleeve 100 can be provided at least partially within an aperture 42 of the cabinet 12 such that a first side 112 of the lip portion 106 abuts a side wall of the cabinet 12 (e.g., second side wall 24) and an opposing second side 114 of the lip portion 106 faces away from the side wall. When a projection 40 of the shelf 32 is inserted at least partially into the aperture 104 of the ribbed sleeve 100, the one or more ribs 110 can deflect to permit insertion of the projection 40 within the aperture 104, as shown in FIG. 9. Moreover, the one or more ribs 110 will help hold the projection 40 within the aperture 104, thereby inhibiting radial movement of the projection 40 within the aperture 104, as well as lateral movement of the shelf 32 between the first and second side walls 22, 24.

Figure 10:
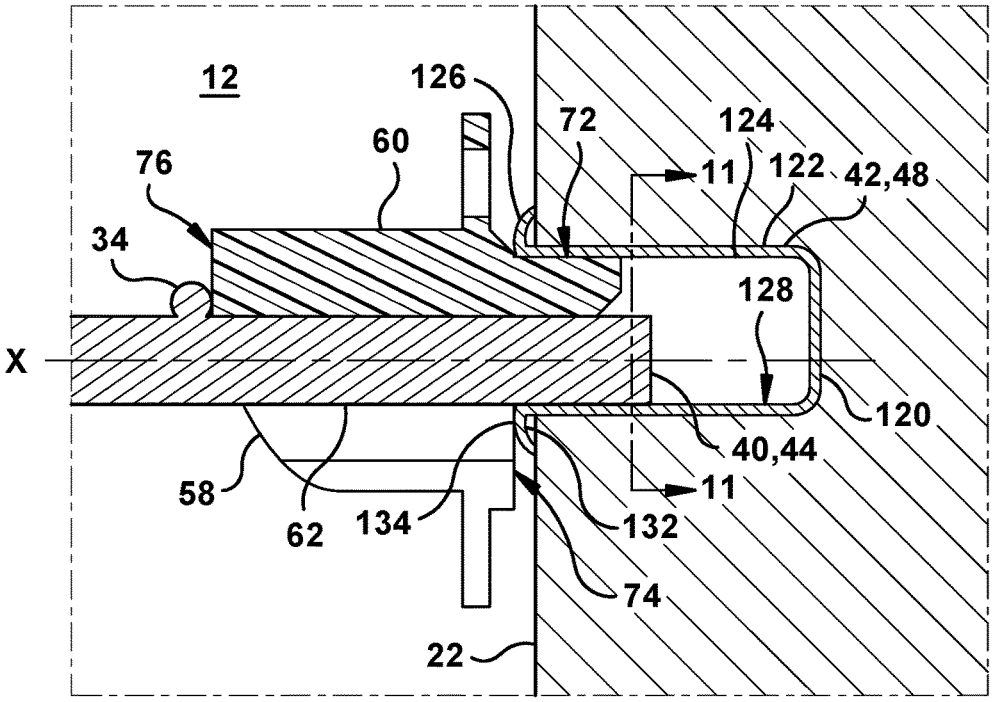
FIG. 10 is a cross-section view of a projection of the shelf provided at least partially within an aperture of the cabinet, with a non-ribbed sleeve provided at least partially within the aperture.
Figure 11:
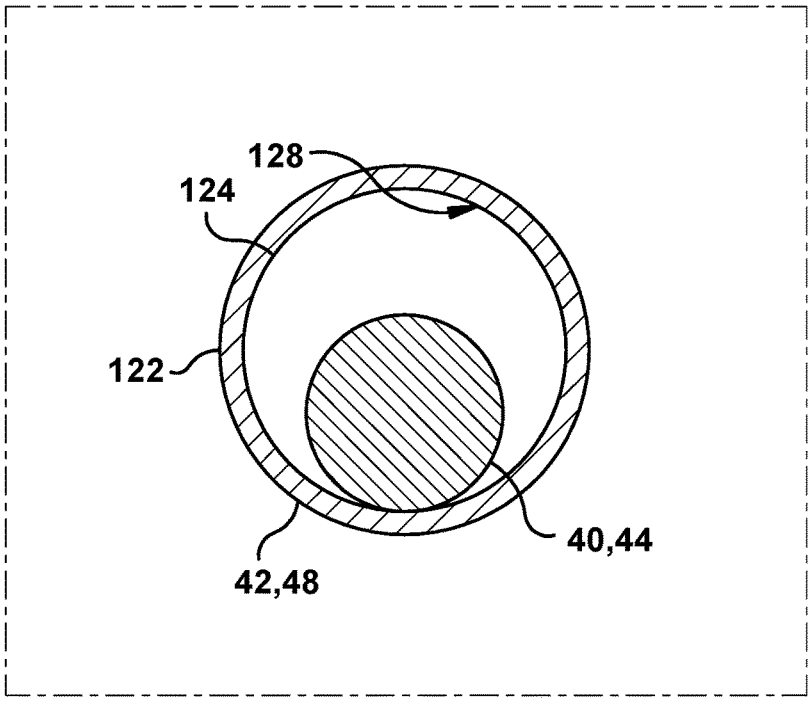
FIG. 11 is a cross-section view taken along line 11-11 in FIG. 10.

In some examples, the appliance 10 can include a non-ribbed sleeve 120 that can be at least partially provided within one or more apertures 42 of the cabinet 12, as shown in FIGS. 10 & 11. In particular, the non-ribbed sleeve 120 can be provided within an aperture 42 that will have a spacer 58 inserted therein (e.g., an aperture 42 in the first set of apertures 48), though other apertures 42 are possible. The non-ribbed sleeve 120 can include a tubular body 122 having an aperture 124 extending therethrough and a lip portion 126 extending circumferentially outward from the tubular body 122. The tubular body 102 can have an inner circumferential surface 128 that is smooth and does not include any flexible ribs extending inward therefrom.

The non-ribbed sleeve 120 can be provided at least partially within an aperture 42 of the cabinet 12 such that a first side 132 of the lip portion 126 abuts a side wall of the cabinet 12 (e.g., first side wall 22) and an opposing second side 134 of the lip portion 126 faces away from the side wall. A projection 40 of the shelf 32 can then be inserted at least partially into the aperture 124 of the non-ribbed sleeve 120 and a spacer 58 can be mounted to the projection 40 such that the projection 40 extends coaxially through the channel 62 of the spacer 58. Because the non-ribbed sleeve 120 does not include any flexible ribs extending from its inner circumferential surface 128, the insert portion 66 of the spacer 58 can be received at least partially within the aperture 124 of the non-ribbed sleeve 120 along with the projection 40 without interference from any ribs.

When the spacer 58 is mounted to the projection 40, the inner arcuate surface 70 of the spacer's insert portion 66 will abut the projection 40 and the outer arcuate surface 72 of the insert portion 66 will abut the inner circumferential surface 128 of the non-ribbed sleeve 120, thereby inhibiting radial movement of the projection 40 within the non-ribbed sleeve 120. Meanwhile, the second side 134 of the lip portion 126 will abut the first abutment surface 74 of the spacer 58 and the second abutment surface 76 will abut a portion of the shelf 32 (e.g., shelf body 34), thereby spacing the portion of the shelf 32 from the second side 134 of the lip portion 126 by the fixed distance D (and the thickness of the lip portion 126) and preventing lateral movement of the shelf 32 toward the second side 134. Furthermore, the fixed distance D can be designed such that when the shelf 32 is spaced from the second side 134 of the lip portion 126 by the spacer 58, a portion of the shelf 32 will also abut a portion of the an opposing side wall of the cabinet (e.g., second side wall 24). Thus, by mounting the spacer 58 to a projection 40, the spacer 58 can prevent radial movement of the projection 40 within the non-ribbed sleeve 120 and lateral movement of the shelf 32 between the first and second side walls 22, 24, thereby stabilizing the shelf 32.

An example method of assembling the appliance 10 will now be described. The method can include the step of providing the cabinet 12 and shelf 32 described above, as well as one or more of the spacers 58 for spacing a portion of the shelf 32 from a side wall of the cabinet 12 (e.g., first side wall 22). The shelf 32 can be removably installed within the storage compartment 14 of the cabinet 12 by inserting its projections 40 at least partially within the associated apertures 42 in the first and second side walls 22, 24 of the cabinet 12, as shown for example in FIG. 2. The method can further include the step of mounting the one or more spacers 58 onto associated projections 40 of the shelf 32 by moving each spacer 58 relative to its associated projection 40 such that the projection 40 is received within the channel 62 of the spacer 58 via the spacer's conduit opening 64 and the spacer 58 spaces a portion of the shelf 32 (e.g., shelf body 34) from a side wall (e.g., first side wall 22) of the cabinet 12 by a minimum fixed distance. For example, the spacer 58 can be mounted according to any of the configurations described above.

In some examples, the method can include the step of providing the ribbed sleeve 100 and/or non-ribbed sleeve 120 discussed above. Prior to inserting the projections 40 of the shelf 32 within the associated apertures 42 of the cabinet 12, the one or more of the sleeves 100, 120 can be inserted into the associated apertures 42 to provide a bearing interface between the cabinet 12 and the projections 40. For example, the one or more of the sleeves 100, 120 can be inserted into the associated apertures 42 according to any of the configurations described above. The projections 40 of the shelf 32 can then be inserted into the one or more of the sleeves 100, 120 and the one or more spacers 58 can be mounted to the projections 40 as described above.

The invention has been described with reference to example embodiments described above. Modifications and alterations will occur to others upon a reading and understanding of this specification. Example embodiments incorporating one or more aspects described above are intended to include all such modifications and alterations insofar as they come within the scope of the appended claims.

What is claimed is:

1. A spacer for an appliance comprising a cabinet and a shelf having a projection partially received within an aperture in a side wall of the cabinet, the spacer comprising:

a conduit portion extending partially about an axis so as to define a channel extending through the conduit portion along the axis and a conduit opening extending radially through the conduit portion along the axis to provide access to the channel in a radial direction with respect to the axis, wherein the channel is adapted to receive the projection of the shelf by the insertion of the projection through the conduit opening in a radial direction with respect to the axis; and an insert portion that extends axially from the conduit portion, wherein the conduit portion includes a first abutment surface extending orthogonal to the axis and a second abutment surface extending orthogonal to the axis that faces away from the first abutment surface and is axially spaced from the first abutment surface a fixed distance, and wherein the first abutment surface extends from the axis a greater radial distance than the insert portion.

2. The spacer of claim 1, wherein the second abutment surface is curved such that a bottom portion of the second abutment surface is axially spaced closer to the first abutment surface than a top portion of the second abutment surface.

3. The spacer of claim 1, further comprising a flange member that extends radially from the conduit portion and defines a flange opening that extends radially through the flange member to provide access to the channel.

4. The spacer of claim 3, wherein at least one of the flange member and the conduit portion comprises an aperture extending axially therethrough.

5. The spacer of claim 1, wherein the insert portion comprises an inner arcuate surface and an outer arcuate surface that extend axially from the conduit portion about the axis.

6. The spacer of claim 1, wherein the conduit opening is radially tapered such that a width of the conduit opening increases along an outward radial direction from the axis.

7. The spacer of claim 1, wherein the first abutment surface comprises a chamfered portion provided axially opposite of the conduit opening.

8. The spacer of claim 1, wherein the spacer comprises polyethylene.

9. An appliance comprising:

a cabinet defining a storage compartment, the cabinet having a first side wall and an opposing second side wall;

a shelf that is removably installed within the storage compartment, the shelf comprising a first projection partially received within a first aperture in the first side wall and a second projection on an opposing side of the shelf as the first projection that is partially received within a second aperture in the second side wall; and a spacer that spaces a portion of the shelf from the first side wall of the cabinet, the spacer comprising:

a conduit portion extending partially about an axis so as to define a channel extending through the conduit portion along the axis and a conduit opening extending radially through the conduit portion along the axis to provide access to the channel in a radial direction with respect to the axis, wherein the first projection of the shelf is received within the channel by the insertion of the first projection through the conduit opening in a radial direction with respect to the axis, and an insert portion that extends axially from the conduit portion, wherein the conduit portion includes a first abutment surface extending orthogonal to the axis and a second abutment surface extending orthogonal to the axis that is axially spaced from the first abutment surface a fixed distance and faces away from the first abutment surface, and wherein the first abutment surface extends from the axis a greater radial distance than the insert portion.

10. The appliance according to claim 9, further comprising a first sleeve provided at least partially within the first aperture and a second sleeve provided at least partially within the second aperture, wherein the first projection of the shelf and the insert portion of the spacer are provided at least partially within the first sleeve and the second projection of the shelf is provided at least partially within the second sleeve.

11. The appliance according to claim 10, wherein the first sleeve comprises a tubular body and a lip portion extending circumferentially outward from the tubular body, further wherein one side of the lip portion abuts the first side wall of the cabinet and another opposing side of the lip portion abuts the first abutment surface of the spacer.

12. The appliance according to claim 11, wherein the second abutment surface of the spacer abuts the portion of the shelf.

13. The appliance according to claim 10, wherein the first sleeve comprises a first tubular body having a first inner circumferential surface and the second sleeve comprises a second tubular body having a second inner circumferential surface, further wherein the second sleeve comprises at least one rib extending inward from its second inner circumferential surface and the first sleeve has no ribs extending inward from the first inner circumferential surface.

14. The appliance according to claim 9, wherein the insert portion comprises an inner arcuate surface and an outer arcuate surface that extend axially from the conduit portion about the axis.

15. The appliance according to claim 14, further comprising a first sleeve provided at least partially within the first aperture and a second sleeve provided at least partially within the second aperture, wherein the first projection of the shelf and the insert portion of the spacer are provided at least partially within the first sleeve and the second projection of the shelf is provided at least partially within the second sleeve, and wherein the inner arcuate surface of the insert portion abuts the first projection and the outer arcuate surface of the insert portion abuts an inner circumferential surface of the first sleeve.

16. A method of assembling an appliance comprising:

providing a cabinet that defines a storage compartment, the cabinet having a first side wall and an opposing second side wall;

providing a shelf that is removably installed within the storage compartment, the shelf comprising a first projection partially received within a first aperture in the first side wall and a second projection on an opposing side of the shelf as the first projection that is partially received within a second aperture in the second side wall;

providing a spacer for spacing a portion of the shelf from the first side wall of the cabinet, the spacer comprising:

a conduit portion extending partially about an axis so as to define a channel extending through the conduit portion along the axis and a conduit opening extending radially through the conduit portion along the axis to provide access to the channel in a radial direction with respect to the axis, wherein the channel is adapted to receive the first projection of the shelf by the insertion of the first projection through the conduit opening in a radial direction with respect to the axis, and an insert portion that extends axially from the conduit portion, wherein the conduit portion includes a first abutment surface extending orthogonal to the axis and a second abutment surface extending orthogonal to the axis that is axially spaced from the first abutment surface a fixed distance and faces away from the first abutment surface, and wherein the first abutment surface extends from the axis a greater radial distance than the insert portion;

moving the spacer relative to the first projection such that the first projection is received within the channel of the spacer via the conduit opening and the spacer spaces a portion of the shelf from the first side wall of the cabinet by a minimum fixed distance.

17. The method of claim 16, further comprising the step of inserting a first sleeve at least partially within the first aperture of the cabinet and a second sleeve at least partially within the second aperture of the cabinet.

18. The method of claim 17, wherein the first sleeve comprises a first tubular body having a first inner circumferential surface and the second sleeve comprises a second tubular body having a second inner circumferential surface, further wherein the second sleeve comprises at least one rib extending inward from its second inner circumferential surface and the first sleeve has no ribs extending inward from the first inner circumferential surface.

19. The method of claim 18, wherein the first projection of the shelf and the insert portion of the spacer are provided at least partially within the first sleeve and the second projection of the shelf is provided at least partially within the second sleeve.

20. The method of claim 17, wherein the insert portion comprises an inner arcuate surface and an outer arcuate surface that extend axially from the conduit portion about the axis, further wherein the spacer is moved relative to the first projection such that the inner arcuate surface abuts the first projection and the outer arcuate surface abuts an inner circumferential surface of the first sleeve.

* * * * *